US007331345B2

(12) United States Patent
Haston

(10) Patent No.: US 7,331,345 B2
(45) Date of Patent: Feb. 19, 2008

(54) DEMAND REGULATOR PROTECTIVE BELLOWS

(75) Inventor: David V. Haston, Glendora, CA (US)

(73) Assignee: Survivair Respirators, LLC, Wilmington, DE (US)

( * ) Notice: Subject to any disclaimer, the term of this patent is extended or adjusted under 35 U.S.C. 154(b) by 630 days.

(21) Appl. No.: 10/354,771

(22) Filed: Jan. 30, 2003

(65) Prior Publication Data

US 2004/0149286 A1 Aug. 5, 2004

(51) Int. Cl.
*A62B 7/00* (2006.01)
*A62B 9/02* (2006.01)

(52) U.S. Cl. ..... 128/204.29; 128/204.28; 128/204.18; 128/205.24; 128/205.25; 137/505; 137/510; 137/78.1; 137/81.2

(58) Field of Classification Search ..... None
See application file for complete search history.

(56) References Cited

U.S. PATENT DOCUMENTS 4,821,767 A 4/1989 Jackson
5,016,627 A 5/1991 Dahrendorf et al.
5,357,950 A * 10/1994 Wippler et al. ..... 128/205.24
6,091,331 A 7/2000 Toft
6,398,078 B1 * 6/2002 Moran et al. ..... 222/173
6,966,316 B2 * 11/2005 Lowry ..... 128/204.26

FOREIGN PATENT DOCUMENTS

WO 2005000409 A1 1/2005

* cited by examiner

*Primary Examiner*—Glenn K. Dawson
(74) *Attorney, Agent, or Firm*—Knobbe, Martens, Olson & Bear, LLP

(57) ABSTRACT

A self contained breathing apparatus (SCBA) served by a source of breathing gas with a mask and a demand regulator connected to the mask. The regulator has a flexible diaphragmatic member having a side exposed to pressure differentials to cause a valve mechanism to introduce breathing gas to the mask. An expanding and contracting member and a chamber fluidically connected to the diaphragm compensates for movement of the diaphragm while shielding the diaphragm from ambient contaminants.

35 Claims, 7 Drawing Sheets

40
230
110
108
232
112
234
42
102
103
86

321c
323c

DEMAND REGULATOR PROTECTIVE BELLOWS

BACKGROUND OF THE INVENTION

1. Field of the Invention

The field of this invention is within the art of breathing gas regulators. It pertains to those breathing gas regulators that are often referred to as demand or second stage regulators that regulate an intermediate pressure that can be used by a party breathing from a self contained breathing apparatus. More particularly, the invention incorporates a second stage regulator having a diaphragm which can be made in part of an elastomeric material which flexes inwardly and outwardly upon a user's breathing.

2. Description of the Prior Art

The prior art of self contained breathing apparatus (SCBA's) relies upon a source of breathing gas such as a pressurized tank of air. The pressurized tank is connected to a first stage or high pressure regulator to regulate the high pressure. From the first stage regulator, a connection is made to a second stage or demand regulator.

The second stage regulator is such wherein a user can breath the breathing gas from the second stage or demand regulator upon inhalation. Such second stage regulators are often used in conjunction with masks for purposes of providing breathing gas under pressure free from contaminants.

As can be appreciated, self contained breathing apparatus is often used in fire and rescue work as well as in industrial environments where certain atmospheres would be deleterious to a user.

The use of such fire, rescue and industrial self contained breathing apparatus is such where it is often exposed to contaminated gases that can attack certain portions of a regulator over an extended period of time. Such contaminated gases and contaminants can be in the form of those gases that are currently known with regard to chemical warfare. Also, certain deleterious gases and contaminants can be generated from industrial fires, explosions, and other conditions. Such chemical contaminants can affect a user of self contained breathing apparatus such as a fireman or an industrial clean-up worker.

Another problem with regard to self contained breathing apparatus in severe environments where contaminants are being used pertains to those gases in chemical warfare. One of these gases is known as Sarin gas. Also, chemical, biological, radiological and nuclear contaminants can affect a mask adversely. This is particularly true when the mask and the breathing apparatus relies upon an elastomeric diaphragm in order to effect the demand regulator functions as is known in the prior art.

Contaminants such as Sarin gas and other deleterious substances can affect such elastomeric diaphragms adversely. The diaphragms are often times made of an elastomeric material, whether it be silicone rubber or other types of elastomerics which are subject to deterioration when exposed to such gases and contaminants.

Elastomers generally have a matrix which can create interstices in adverse environments when contaminants are exposed to the surface of such elastomers. In effect, the contaminants disperse into the rubber and are then eventually transmitted to the other side to one degree or the other.

It has been found that such contaminants can permeate the diaphragm of a demand regulator over a given period of time. However, with the use of this invention, it has substantially extended that period of time.

Self contained breathing apparatus is usually under positive pressure within the mask and in the regulator area in order to exclude any contaminants from seeping into the mask. By maintaining a positive pressure within the mask above ambient or atmospheric pressure, the seal around a user's face and the other areas can exclude contaminants and other deleterious gases. As can be understood, a simple contaminant such as smoke, if leaked into the mask, could cause a severe problem for a fireman or industrial worker.

It has been found that when the air within the portion overlying the regulator diaphragm is protected from ambient conditions it will protect the diaphragm. By substantially excluding contaminants from coming into the regulator over the diaphragm, it will increase longevity of the diaphragm.

An SCBA regulator normally has a diaphragm which is exposed to ambient and flexes upon inhalation. Exposure to the ambient conditions is such where deleterious gases and contaminants can reach the surface of the elastomeric diaphragm. When these gases and contaminants are substantially eliminated by a bellows or expansion and contraction member, it has been found that a greater degree of longevity can be encountered with the diaphragm lasting longer.

This invention is directed toward increasing the longevity of a regulator diaphragm by a sealing bellows or expansion and contraction member. Breathing gas or a compressible fluid is retained above the diaphragm and substantially displaces deleterious gases and contaminants from over the diaphragm of the SCBA demand regulator. The bellows or expansion and contraction member provides a protective cover, while at the same time allowing differential pressure movements of the diaphragm. This allows operation of the regulator diaphragm while at the same time protecting it.

SUMMARY OF THE INVENTION

In summation, this invention comprises a self contained breathing apparatus (SCBA) having a demand regulator with a diaphragm that flexes and moves upon pressure differentials such as inhalation, and has an improved protective chamber with an overlying bellows to maintain non-contaminated breathing gas or other compressible fluid over the surface of the diaphragm while maintaining its normal functions.

More particularly, the invention comprises an SCBA having a source of breathing gas such as a tank of air. The breathing gas is regulated by a high pressure or first stage regulator to an intermediate pressure. The regulated intermediate pressure gas is conducted to a second stage or demand regulator.

The second stage or demand regulator is emplaced within a mask having a lens and skirt for sealing the mask to a user's face. Within the demand regulator is a diaphragm which moves in response to a user's inhalation, exhalation, or other pressure differential, movements. The diaphragm is connected to a valve apparatus which opens and closes thereby conducting gas to a user.

The diaphragm is normally exposed to ambient atmospheric conditions so that any contaminants or deleterious gases could affect the outer surface.

In order to protect the outer surface of the diaphragm from deleterious gases or contaminants a closed chamber is disposed across the face thereof. The chamber or space is over the diaphragm and has a bellows or expansion and contraction member which allows for the diaphragm to respond to pressure differentials. A substantially clean gas space over the diaphragm is maintained while at the same time allowing diaphragm movement due to the bellows or the diaphragm. This serves to preserve the elastomer of the diaphragm for an extended period of time.

DETAILED DESCRIPTION OF THE PREFERRED EMBODIMENTS

Figure 1:
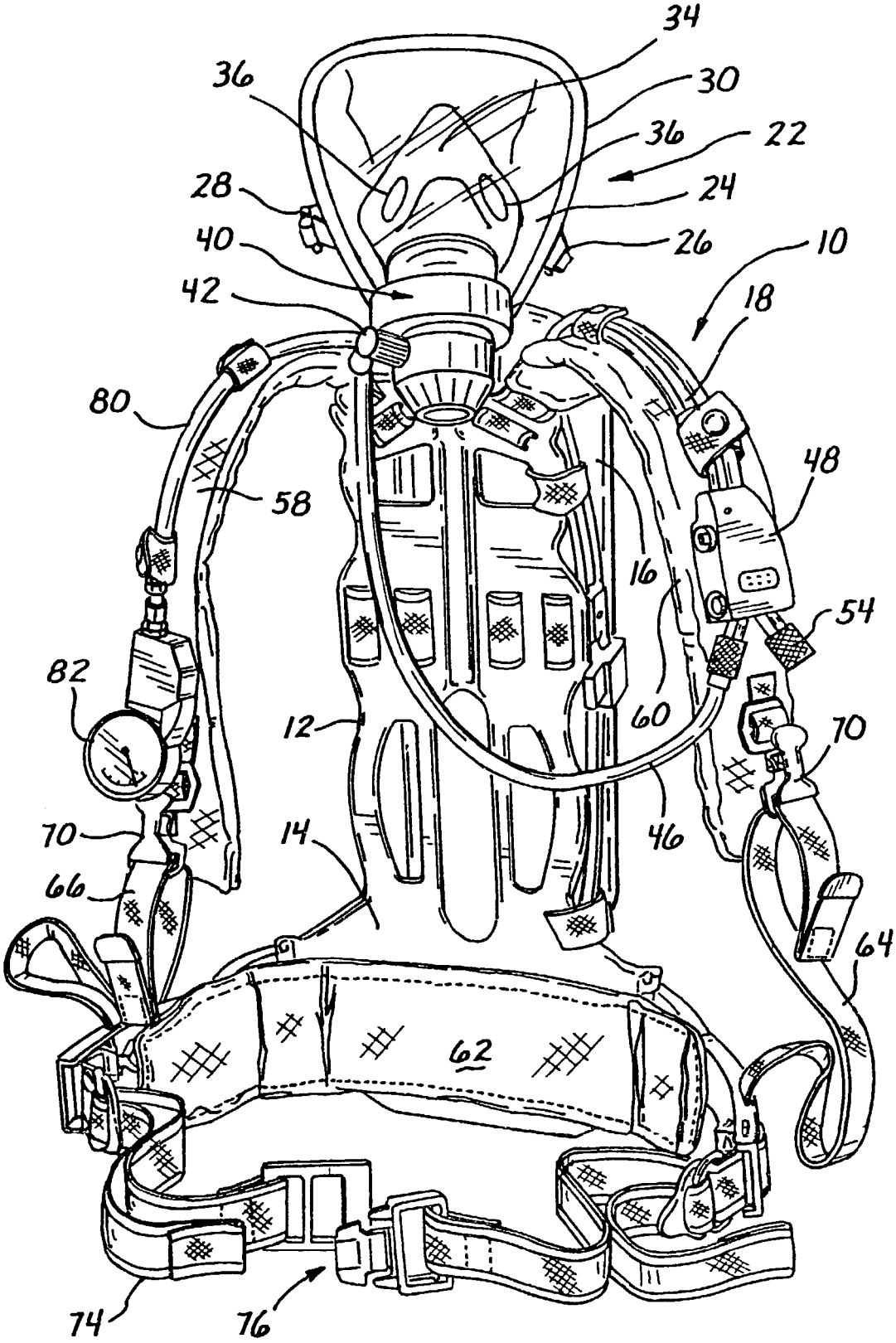
FIG. 1 shows a perspective view of the self contained breathing apparatus (SCBA) of this invention.

Looking more specifically at FIG. 1 it can be seen that a self contained breathing apparatus (SCBA) 10 has been shown. The self contained breathing apparatus 10 incorporates a backpack 12. The backpack 12 generally is of an inverted T shaped configuration having a cross member 14 thereof.

The backpack 12 has straps in the back in order to carry a tank 16 of breathing gas. The tank 16 of breathing gas is fluidly connected by means of a high pressure regulator and a valve which is not shown in the back. The high pressure regulator regulates gas to an intermediate pressure hose or conduit 18.

In order to provide a user with a protective environment, a mask 22 is provided having a lens 24. A pair of strap attachments 26 and 28 are shown which secure the mask to a user's face. The frame of the mask 22 is in the form of a metal or other stiff frame 30 to which the structure of the lens 24 and the straps 26 and 28 are connected.

Interiorly of the mask 22 is an oral nasal mask 34. The oral nasal mask 34 has gas delivered thereinto through valves 36 on either side. The gas is exposed to the lens 24 which helps to clear the mask of moisture and condensation. A user can breath through the valve 36 from air supplied through a second stage regulator.

A second stage or demand regulator 40 is shown. The second stage or demand regulator 40 has a bypass valve operably attached to a knob 42. The bypass valve attached to the knob 42 allows for air to be delivered directly to the mask 22 without the regulator functions.

In order to deliver breathing gas to the second stage regulator 40, the intermediate pressure passes from the hose 18 through an extension of the hose 46. The extension of the hose 46 is interconnected and passes through a personal alarm safety system 48 which indicates to other people when a user is in a condition wherein he or she requires emergency help. The personal alarm safety system 48 is incorporated in this application by reference to U.S. Pat. No. 6,091,331 entitled an Emergency Worker and Fireman's Dual Emergency Warning System issued Jul. 18, 2000 naming Carl Toft; David Haston; Carl Schaefer; and, Duane Decker as inventors, commonly owned herewith.

A quick disconnect coupler 54 is shown which allows a second party to receive gas from the breathing gas source in case the second party's apparatus fails.

In order to hold the backpack and the entire self contained breathing apparatus to a user, shoulder straps 58 and 60 are shown. The shoulder straps 58 and 60 are connected to a hip pad 62 having adjustment straps 64 and 66 with alligator clips or adjustments 70.

In order to further adjust the position of the self contained breathing apparatus 10, a waist belt 74 is shown having a buckle 76 with a quick disconnect.

A line 80 is connected to the high pressure side of the SCBA and has a pressure gauge 82 connected to it in order to mechanically apprise a user of the amount of pressure remaining in the tank.

Figure 2:
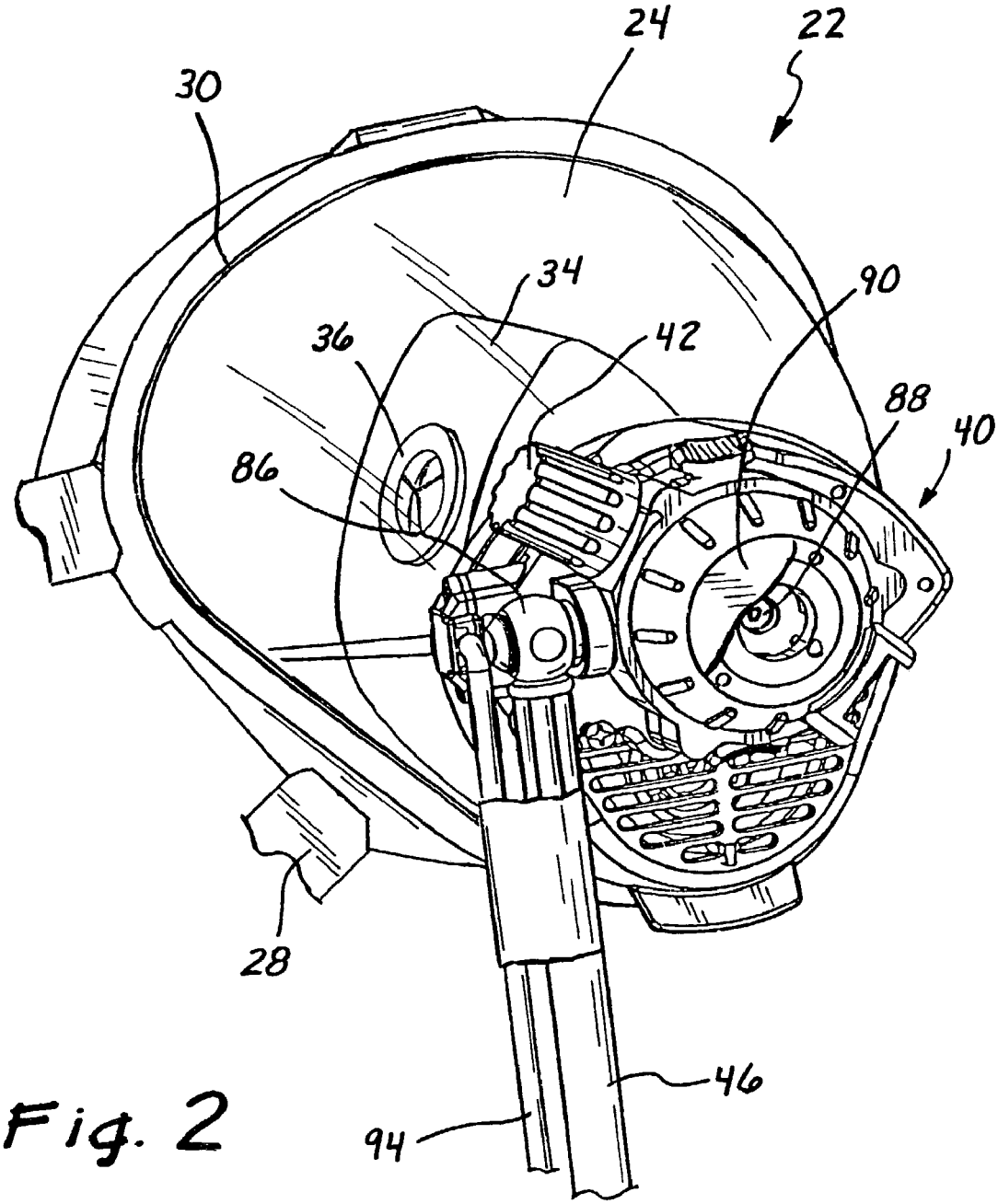
FIG. 2 shows a perspective view of a mask and demand regulator of the self contained breathing apparatus as shown in FIG. 1.

Looking at FIG. 2, the regulator 40 can be seen along with the mask 22 with its attendant lens 24, oral nasal mask 34, and rim 30 which provides a frame. The regulator 40 can be seen attached to the oral nasal mask 34 with a valve 36 on either side. Air delivered into the mask 22 at a positive pressure can be inhaled by a user through the valves 36 into the oral nasal mask 34.

The demand regulator 40 is served by the intermediate pressure that has been regulated from its high pressure and conducted through a conduit 46 which is connected to a swivel fitting 86. The swivel fitting 86 allows gas to be introduced to the regulator 40 for demand regulation. A purge button 88 is shown with a cover 90 for allowing a user to push the button and provide for the introduction of air or other breathing gas from the tank 16 into the mask 22. A bypass valve can be turned with a bypass knob 42 to allow gas to be introduced through the regulator 40.

In order to provide for data on a user's display, a connecting line 94 is shown. Signals from a processor or other device connected to a transducer for monitoring tank 16 pressure can provide such items as pressure of the gas in the tank as well as other electrical timing functions to be displayed within the mask 22.

Figure 3:
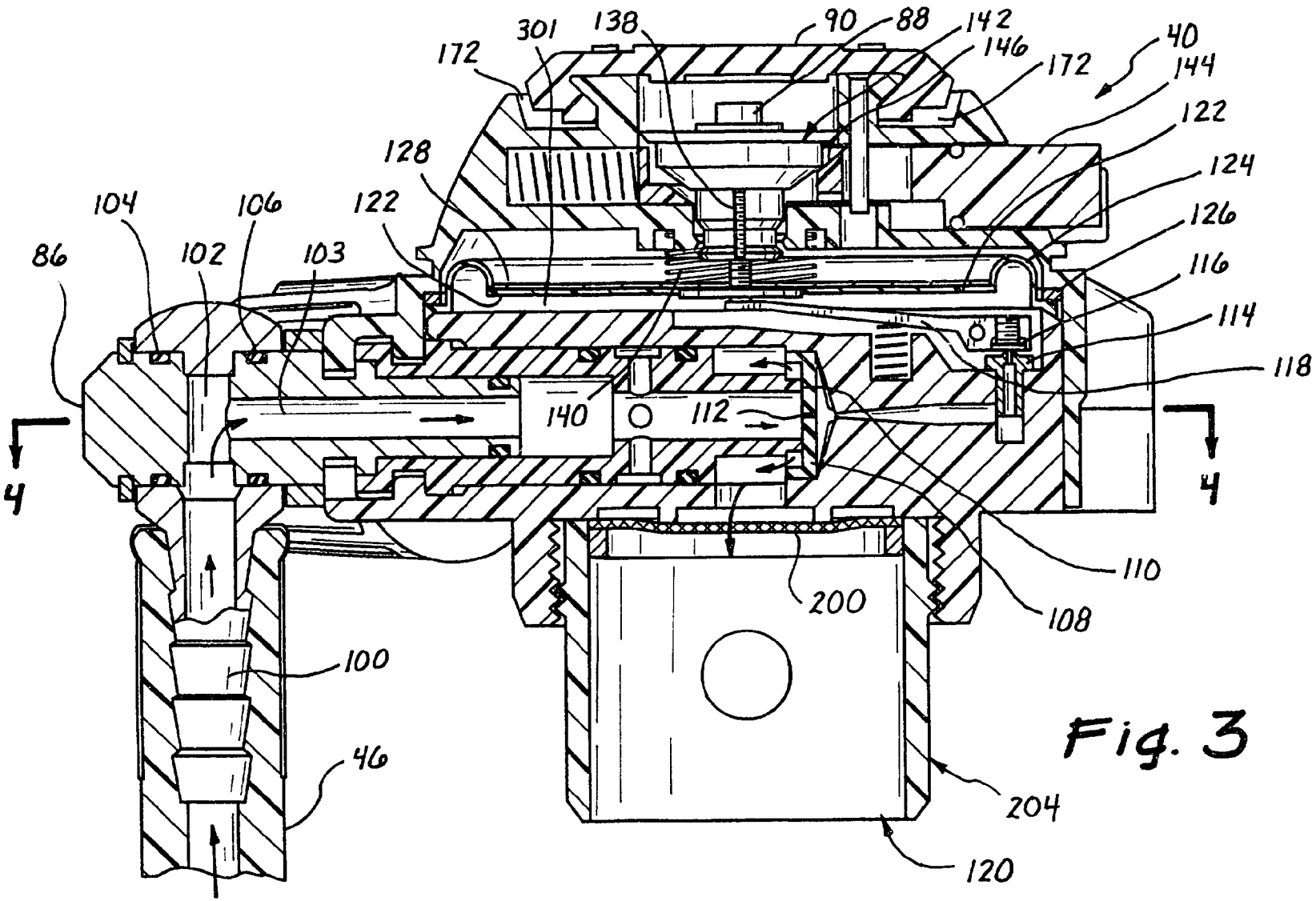
FIG. 3 shows a cross-sectional view through the regulator in the direction of lines 3-3 of FIG. 2A.

The swivel connector 86 can be seen in FIG. 3 in a cross-section wherein the hose 46 has been connected thereto by means of a barbed fitting 100. The barbed fitting 100 is seated such that the hose 46 directly connects to a passage 102 sealed by O rings 104 and 106. The breathing gas then travels through a connecting passage 103. The passage 103 terminates at a main valve comprising a valve cover 108 having an orifice 112 seated against a valve seat 110. The valve cover 108 with its orifice 112 is controlled by means of a pilot valve 114.

The pilot valve 114 has a pilot valve cover 116 that is in turn connected to a lever 118. The gas flow upon displacement of the valve cover 108 by actuation of the pilot valve cover 116 being unseated by the lever 118 can be seen in the direction of the small arrows. The flow of gas is indicated by the small arrows around the surrounding circumferential groove or chamber and then passing outwardly toward the mask through a main passage 120.

Constant positive pressure in the mask 22 and regulator can be maintained by the pilot valve 114.

The pilot valve 114 is set to provide for a constant minor flow into the mask 22. The pilot valve also serves to cause the main valve with the valve cover 108 to function when a pressure differential is encountered during inhalation. Other positive pressure conduits or connections can be utilized for providing positive pressure both into the mask and behind or on the inside of the operating diaphragm to effect this invention.

In this case the pilot valve is set so that it functions to maintain approximately one and one half inches (water) pressure in the mask 22 and behind or on the inside of diaphragm 122. In effect, the chamber behind or on the inside of the diaphragm 122 is held at a positive pressure as well as the inside of the mask by the pilot valve 114 lifting when pressure drops below a pre-established pressure. The pressure differentials through breathing also cause diaphragm 122 movement with valve functions of the pilot and main valves.

The area of the diaphragm in connected relationship to the lever 118 is referred to herein as the inside, or inside surface or portion of the diaphragm. The opposite surface of diaphragm 122 is referred to as the outside or outside surface or portion of the diaphragm. Normally the outside would be exposed to ambient to provide for pressure differentials upon breathing. However this invention allows response to pressure differentials for breathing without direct exposure of diaphragm 122 to the ambient.

The regulator 40 functions by means of the diaphragm 122 supported at either end by a circumferential groove or flange 124 formed by a channel for greater flexural response. The groove, or flange 124 has a terminal point which seats in the regulator behind a ring member 126.

The diaphragm 122 flexes inwardly and outwardly upon pressure changes and differentials in order to cause the lever 118 to function. In effect the pilot valve 114 operates to maintain the positive pressure as well as providing gas for inhalation. The diaphragm 122 is backed by a support plate 128 that is stiffer than the elastomeric diaphragm and can be made of metal or plastic. The support plate 128 allows for sufficient support and stiffening of the diaphragm 122 so that it does not collapse entirely during inhalation and exhalation or other pressure changes.

The diaphragm 122 is connected to a screw member 138 that is spring biased by a coil spring 140 on the outside of the diaphragm interfacing with an inverted cam driven member 142. The inverted cam driven member 142 is driven over detents at one end. This occurs when displacement by a cam driver rod 144 pushes a surface 146 against the member 142 lifting it upwardly by the cam rod 144 overcoming the coil spring 140 and the detents.

When the diaphragm 122 is then pulled in by a breath, it functions to allow for the continued operation of the regulator 40. The operation of the regulator 40 hereof as to its basic features including the cam member 142 with its detents as well as the other functions have been set forth in U.S. Pat. No. 5,357,950 issued Oct. 25, 1994 entitled Breath Actuated Positive Pressure Demand Regulator With Override naming John Wippler and Max L. Kranz inventors. This patent is commonly assigned to the assignee hereof.

As in the prior art, the elastomeric button 90 can flex downwardly to press against the purge or flow button 88 to allow for the flow of air or gas by displacing the pilot valve cover 116.

This invention provides for a substantially less deleterious environment surrounding the diaphragm 122 by way of excluding the ambient from its outside surface. This can be seen more specifically in FIG. 5.

The overall volume of the regulator above the diaphragm namely the volume within space or chamber 186 is approximately 25 cubic centimeters (CC) in volume. This volume is sufficient to permit flexure of the diaphragm 122 under the aspects of the invention described herein.

Figure 5:
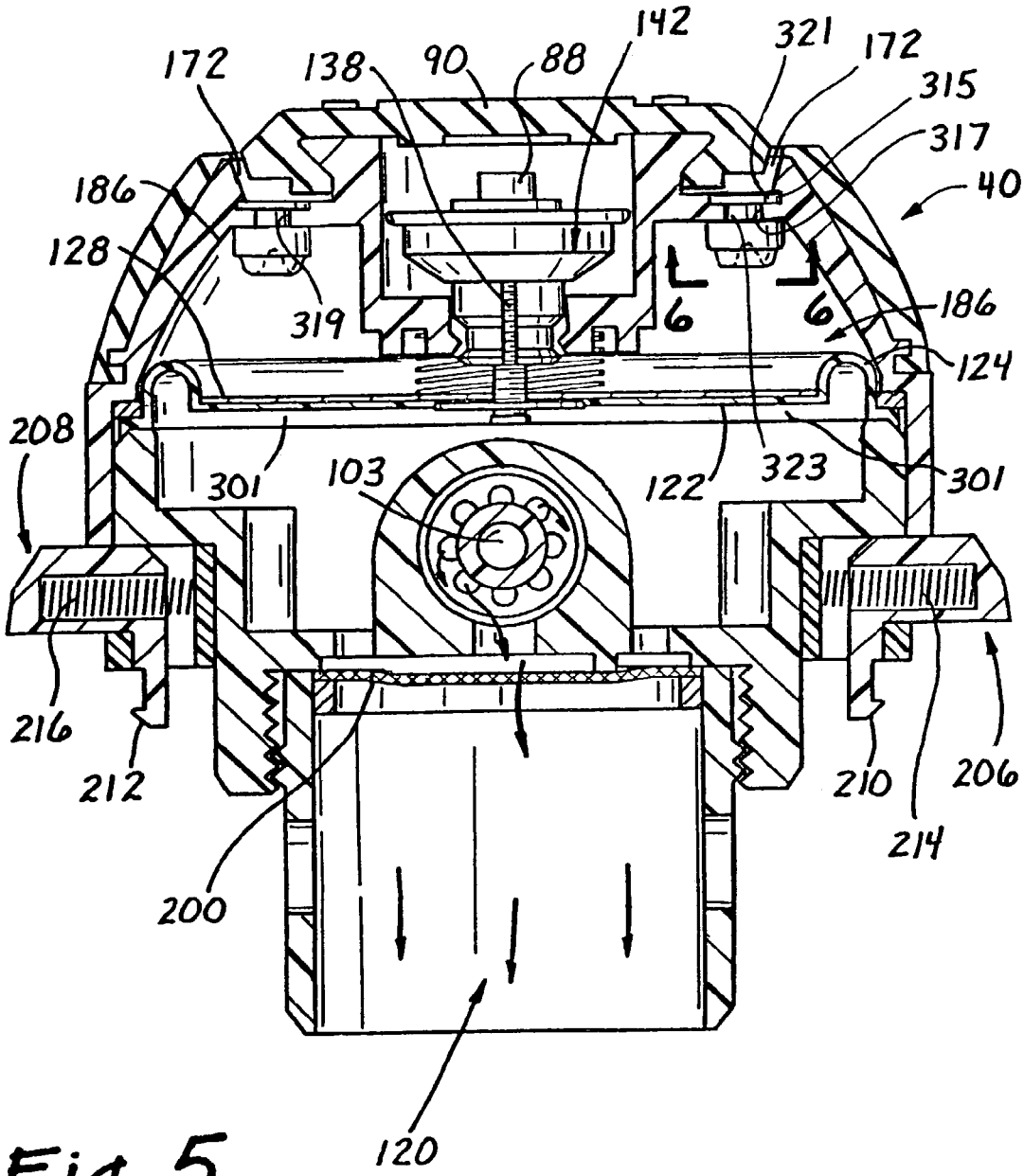
FIG. 5 shows a sectional view along lines 5-5 of FIG. 2A illustrating the bellows or expansion and contraction member.

Again, looking more specifically at FIG. 5 it can be seen that the breathing gas is delivered through the regulator 40 to the mask 22 by means of an interconnecting port or main passage 120. This is in the direction of the arrows indicated in the port or main passage 120.

Flow through the port 120 is preceded by one or more screens 200. These screens are respectively held in place by means of a threaded outlet 204.

In order to attach the regulator 40 to the mask 22, a pair of spring loaded latches 206 and 208 are provided. The spring loaded latches 206 and 208 have spring biased connecting latches 210 and 212 respectively biased by springs 214 and 216. In this manner, they are allowed to engage an interior lip, ridge, flange, or other mating configuration of the mask. This enables the regulator 40 to be attached and disconnected from the mask 22 at a user's discretion.

Figures 4, 12:
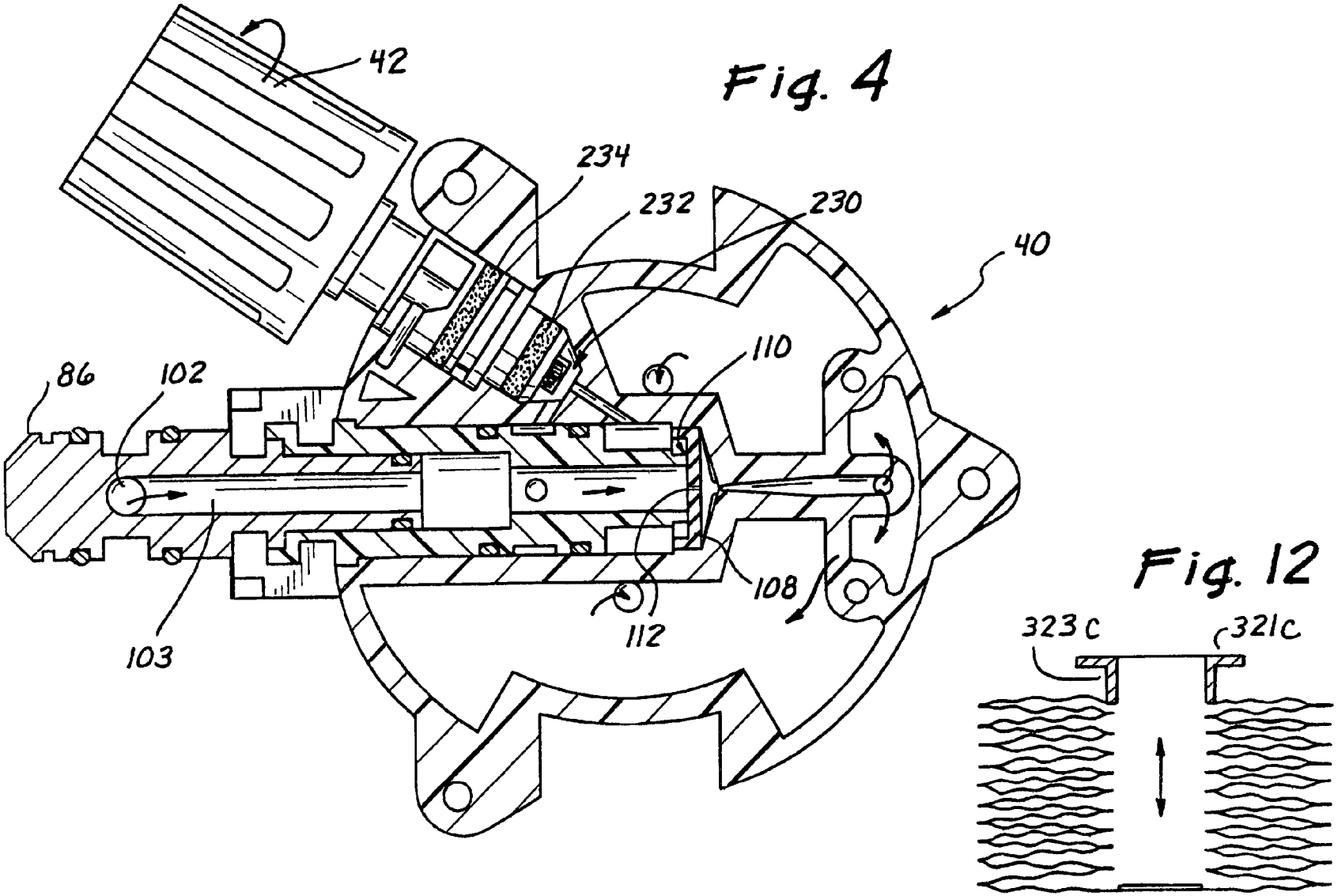
FIG. 4 shows a sectional view along lines 4-4 to the midline area of the regulator shown in FIG. 3.
FIG. 12 is a sectional view of an alternative bellows-like expansion and contraction member.

FIG. 4 shows a midline view in the direction of lines 4-4 of FIG. 3. It specifically details the bypass valve action when the knob 42 is turned. In particular, the bypass valve has a seat 230 which allows the passage of air through the regulator 40 directly into the mask 22 for a user. It is sealed by two O ring seals 232 and 234 so that when it is turned the breathing gas will not substantially slip by the interfaces thereof.

Figure 2A:
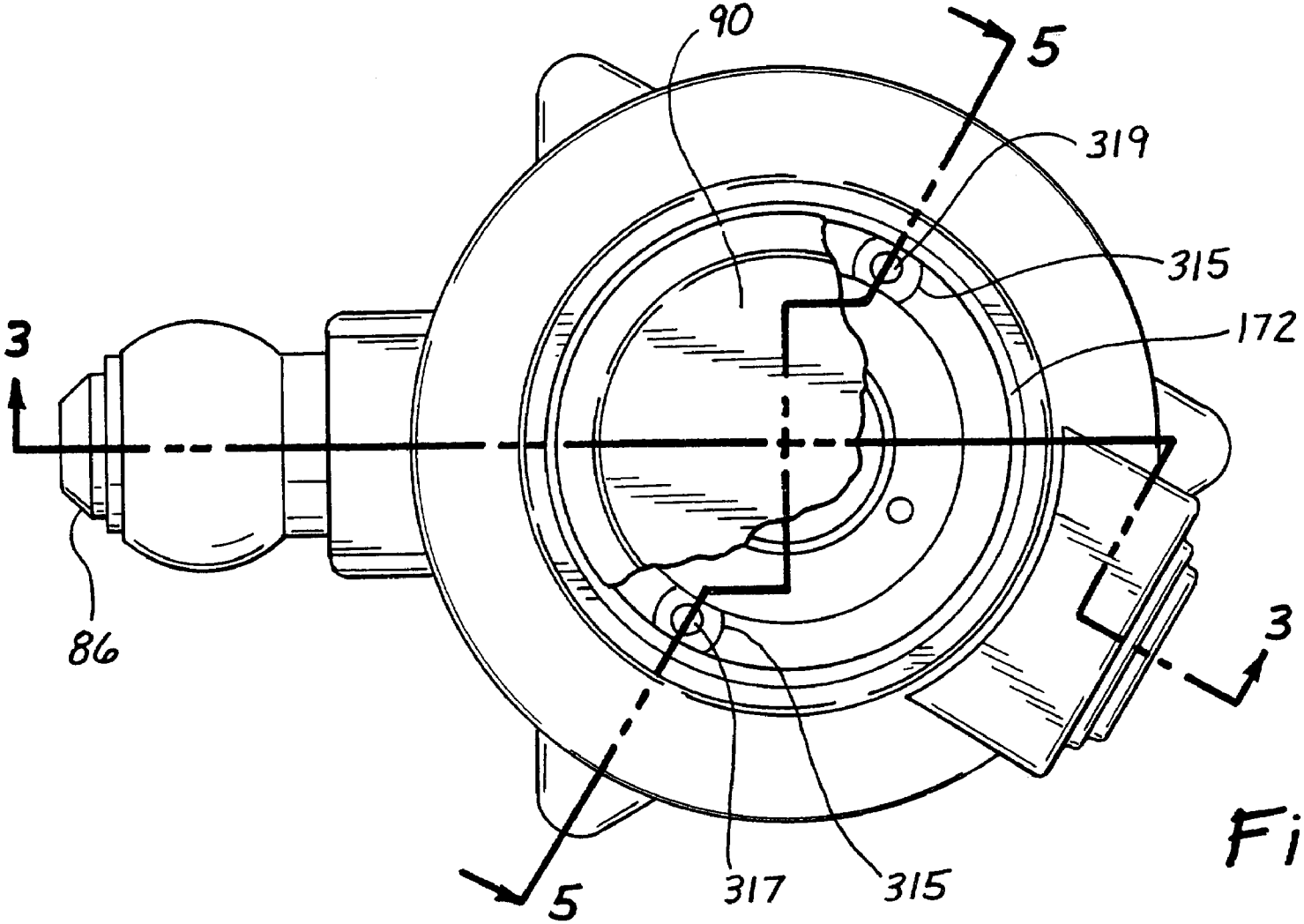
FIG. 2A shows a broken away view of a portion of the demand regulator.

Looking more specifically at FIG. 3 in conjunction with FIG. 5, it can be seen that the regulator 40 has been shown with a view in FIG. 5 along lines 5-5 of FIG. 2A. Here again, the diaphragm 122 is shown with a flexible elastomeric nature to it enhanced by the channel, groove or flexure area 124. Also, the opposite side is shown with the reinforcing plate 128.

For purposes of reference, a chamber, space, or enclosure 186 is shown on top or on the outside of the diaphragm. The chamber 186 with the diaphragm 122 exposed thereto in particular the area underlying the re-enforcing plate 128 is referred to as the outside portion of the diaphragm 122. The area underneath or the inside of diaphragm 122 has a chamber or space 301 which responds to respective pressure differentials in order to actuate pilot valve lever 118.

The inside of the diaphragm 122 which is exposed to space 301 moves inwardly and outwardly depending upon the particular pressure differential as previously set for maintaining positive pressure and also when inhalation and exhalation takes place which flexes the diaphragm 122.

The space above the diaphragm or the outside of the diaphragm exposed to space or chamber 186 in the prior art is generally exposed to ambient through one or more holes, passages, or conduits 317 and 319 shown in FIG. 5 which allow ambient air passage from chamber 186 through a space, conduit passage, or opening 172 which surrounds the purge button 90. This opening 172 provides ambient pressure conditions via holes, passages, or conduits 317 and 319 so that the diaphragm 122 can flex inwardly and outwardly.

As can be understood, when the outside of the diaphragm 122 as in the prior art is exposed to such gases as Sarin gas or other contaminants, it can cause a breakdown of the elastomer. This is particularly true when deleterious substances and gases expose the diaphragm 122 in the chamber 186 by reason of the holes, passages, or conduits 317 and 319 and passage 172 to ambient.

This invention particularly allows the diaphragm 122 to operate without the necessity of being exposed to ambient. This is accomplished by means of a bellows type of configuration, or a mushroom, or a balloon type of expansion and contraction member as well as a simple diaphragm. This can be seen in FIGS. 6 through 12. Any expansion and contraction member to move in tandem with the diaphragm 122 can be used so long as it permits sufficient movement of the diaphragm.

The bellows or expansion and contraction member has been detailed in the foregoing figures and is generally inserted in the directions of lines 6-6 of FIG. 5. The insertion of the bellows, balloon, or mushroom type of expansion and contraction member allows for flexure of the diaphragm 122 inwardly and outwardly. When referring to a bellows, any enclosure that expands, contracts, moves, or stretches for fluid movement is referred to herein. The theory is to allow movement of a volume within walls of a member such as an accordion, or stretchable device.

The placement of an expansion and contraction member to allow for pressure differentials through the space, conduit passage, or opening 172 and holes, passages, or conduits 317 and 319 maintains the flexibility and expansibility of the diaphragm 122 to a great extent. In effect, it prevents a fluid restriction that would take place against the chamber 186 on the outside of the diaphragm 122. To eliminate the blocking which would restrict movement of the diaphragm 122, the expansion and contraction member flexes or expands and contracts in concert with the diaphragm 122. Thus, the nature of a compressible fluid such as a breathing gas like air allows for movement to be effected by the diaphragm 122 to operate the lever 118. This causes the pilot valve 114 to function thereby causing the main valve cover 108 to lift for the flow of air through the passage 120 to the mask.

Figure 7:
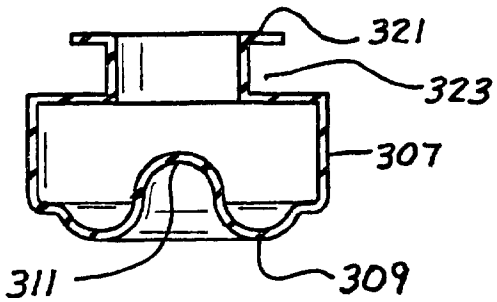
FIG. 7 is a mid-line cross-sectional view of the bellows along lines 7-7 of FIG. 6.
Figure 6:
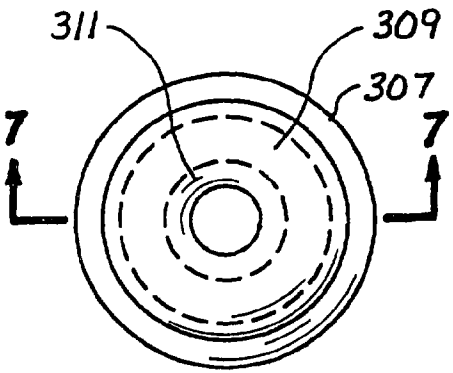
FIG. 6 is a plan view looking at the bellows of this invention shown and emplaced in the direction of lines 6-6 of FIG. 5.

Looking more specifically at FIGS. 6 and 7, which have a bellows analogous to the FIG. 5 showing, it can be seen that a type of bellows configuration is shown with less convolutions. The bellows configuration in FIGS. 6 and 7 show an outside surface or wall 307 which supports a convoluted or ridged portion having a convex outer portion 309 and a concave portion 311. The convolutions or convex and concave portions can be in any number so long as they provide expansion and contraction. In order to seat the bellows member into an opening such as holes, passages, or conduits 317 and 319 a slight undercut is provided in the area surrounding the hole(s). A groove or undercut 315 that is a circumferential groove coaxial to holes, passages, or conduits 317 and 319 is used to seat the bellows or expansion and contraction member.

The bellows in FIGS. 6 and 7 fundamentally cause a flange 321 of the bellows to be seated against the undercut 315. This flange 321 also has an inset 323 that allows for the bellows to be seated within the groove or undercut 315 in holes, passages, or conduits 317 and 319. The seating can be enhanced with an adhesive, washer, or snap ring engagement.

The bellows configuration of FIGS. 6 and 7 allows for the concave portion 311 and convex portion 309 to expand and contract when pressure differentials take place by movement of the diaphragm 122 when the diaphragm 122 moves with respect to the outside. For instance within space 186, it causes the bellows in FIGS. 6 and 7 to move in the same direction to allow for flexure of the diaphragm 122.

Various configurations of the bellows or expansion and contraction members can be provided having multiple convex 309 and concave 311 portions. The bellows in FIGS. 6 and 7 can also be ribbed or created in such a manner so that easy flexure takes place upon inhalation and exhalation or pressure differentials sensed by the diaphragm 122.

Figure 9:
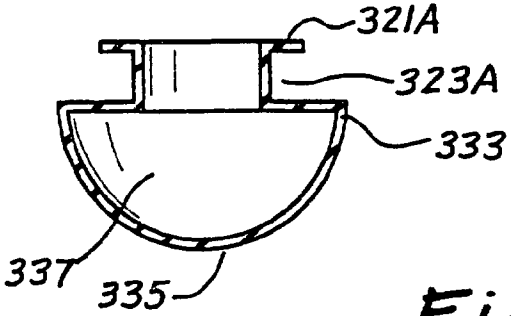
FIG. 9 is a mid-line sectional view along lines 9-9 of FIG. 8.
Figure 8:
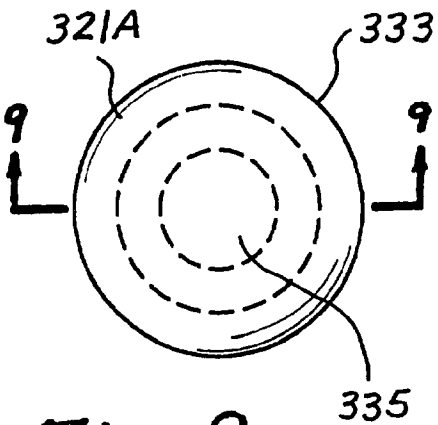
FIG. 8 is a plan view showing of an alternative expansion and contraction member formed as a mushroom.

Looking more particularly at FIGS. 8 and 9, it can be seen that a mushroom type of expansion and contraction member has been shown. The mushroom type of expansion and contraction member can be configured with the flange analogous to the bellows and has been labeled herein as 321A. The space or undercut of the bellows 323 can be used in the analogous manner shown as undercut 323A. In this manner, it can fit snugly within the undercut 315 in holes, passages, or conduits 317 and 319 into which the gap, insert, or space 323A and flange 321A can be seated.

The nature of the mushroom or bellows is such that the outside circumference 333 can provide for flexure along with the curved portion 335. This provides expansion and contraction by movement of the mushroom configuration through its cross-section and the space or chamber 337 in the mushroom member.

Figure 11:
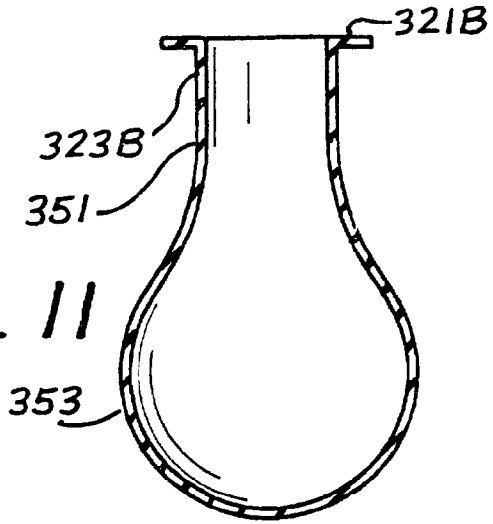
FIG. 11 is a sectional view along lines 11-11 of FIG. 10.
Figure 10:
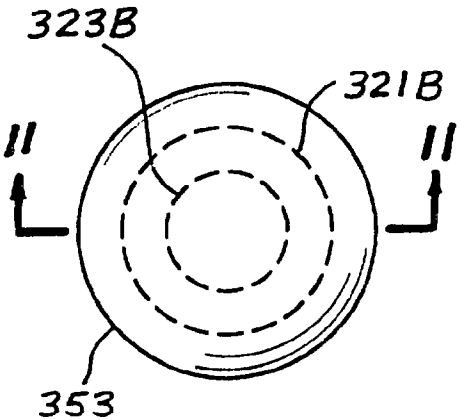
FIG. 10 is plan view of a balloon-like alternative expansion and contraction member.

Looking more specifically at FIGS. 10 and 11 it can be seen that there is a balloon like configuration having a similar flange to flange 321 namely in this case 321B. This flange 321B again seats like flanges 321 and 321A into the undercut 315 in holes, passages, or conduits 317 and 319 in the regulator side wall. Further to this extent, the gap, insert or space 323 and 323A is accommodated by the under portion of the flange 321B located in an extended manner in the form of undercut 323B.

The walls of the balloon type structure extend downwardly in an elongated portion 351 which terminates in a bulbous rounded area 353. The bulbous rounded area is rounded and can be in any configuration to allow for expansion and contraction. It should be understood that any kind of configuration in this particular instance allowing for the expansion and contraction so that the diaphragm 122 can flex inwardly and outwardly is generally sufficient.

Although it has been shown with the portions of the expanding and contracting members having a convex portion interiorly of the chamber 186, it should be understood that the convex portion can be exposed to the ambient on the other side within opening 172. This is based upon the fact that as the diaphragm 122 is drawn inwardly or experiences a pressure differential, the expanding and contracting member can be drawn in with the diaphragm and then moved outwardly. Of course, if the expanding and contracting member were merely a disk or an elastomeric ring or other membrane blocking chamber 172, and was of a relatively flattened nature, it would move inwardly and outwardly in substantially direct relationship to the diaphragm 122.

The expansion and contraction members in FIGS. 6 through 12 have been shown in numerous configurations whereby a particular portion can be sufficiently resilient, elastomeric, and of elasticity as to flex in either direction for accommodating movement of the diaphragm 122. However, it should be understood that various other configurations allowing for a tandem diaphragm with respect to diaphragm 122 can also be utilized. Also, a circumferential diaphragmatic member in the form of a disk that circumscribes the underside of the space 172 to allow for expansion and contraction would in some instances be sufficient. Further to this extent, as long as the diaphragm 122 is sufficiently protected from ambient, a second diaphragm can be used above the space 186. This could allow for expansion and contraction of diaphragm 122 in the same manner as the bellows, mushroom, and balloon shaped expansion and contraction members.

FIG. 12 shows the cross-section of a true bellows configuration having multiple accordion-like side walls. The flange 321*c* with the undercut 323*c* is shown for seating in the regulator. This allows for expansion and contraction in a bellows configuration in the directions of the midline arrow. Thus, any tandem concomitant movement of an expansion and contraction member, diaphragm, elastomeric disk, or other member providing the expansion and contraction member principles for lessening the restriction of the diaphragm 122 when closed off from ambient can be utilized. Fundamentally, the principles of the invention are to protect the diaphragm 122 which is of a sensitive elastomeric nature from contaminants and deleterious gases such as Sarin gas. With this in mind, the nature of an elastomeric or tandemly moving diaphragm, disks, bellows, cylindrical member, or any other elastomeric member including the serrated types of showings of various concaved and convexed cross-sections to effect expansion and contraction of the diaphragm 122 could be sufficient.

The principle is to allow for expansion and contraction of the diaphragm 122 and contraction on the outside and inside with respect to the space 186. With a compressible fluid such as air or other breathing gas within the space 186 and underlying the diaphragm 122 in space 301, the concomitant movement of the expansion and contraction member can effect this. It should also be understood that a flexible expansion and contraction member, flexible membrane, flexible cover, elastomeric sheet, for the expanding and contracting member so long as it performs the function of allowing the diaphragm 122 to move readily can result in improvements provided by this invention.

It will be understood by those skilled in the art that depending upon the diameter and size of the diaphragm 122 as well as the overlying space 186, that variously designed expansion and contraction members can be effected to accommodate movement of the diaphragm 122. This can be done by designing the system so that the two respective members, namely the diaphragm 122 and the expansion and contraction member can move concomitantly and not bind or restrict the movement of the diaphragm 122.

The invention claimed is:

1. A self contained breathing apparatus (SCBA) having a demand regulator comprising:

a source of breathing gas;

a mask with a lens;

a demand regulator connected to said mask and said source of breathing gas;

a flexible member in said demand regulator that moves in response to pressure differentials;

a valve for introducing breathing gas through said regulator to said mask connected for movement in response to movement of said flexible member; and, an expanding and contracting member fluidically connected to said flexible member which can move in an expanding or contracting manner upon movement of said flexible member.

2. The SCBA as claimed in claim 1 further comprising:

said flexible member is at least in part formed of an elastomer.

3. The SCBA as claimed in claim 2 further comprising:

said expanding and contracting member has one side exposed to the outside of said flexible member and the other side exposed to the ambient with a space between said flexible member and said expanding and contracting member.

4. The SCBA as claimed in claim 3 further comprising:

said expanding and contracting member has a cross-section formed of at least one concave and convex portion.

5. The SCBA as claimed in claim 3 further comprising:

said expanding and contracting member has a bellows cross-sectional configuration.

6. The SCBA as claimed in claim 3 further comprising:

said flexible member is at least in part a diaphragm; and, said expanding and contracting member has a mushroom shape.

7. The SCBA as claimed in claim 3 further comprising:

said expanding and contracting member is formed of a balloon shape.

8. The SCBA as claimed in claim 3 further comprising:

a membrane forming said expanding and contracting member having one side exposed to ambient and the other side to said flexible member with a space therebetween for a fluid.

9. A demand breathing gas regulator comprising:

a regulator body for fluid connection to a mask and a source of breathing gas;

a flexible member that is at least in part formed of a diaphragm and that is operably connected to a breathing gas demand valve supported by said regulator body, said flexible member having one side fluidically connected to an inside of the mask with the other side exposed to a fluid chamber;

an expanding and contracting member that is an elastomeric member having a convex or concave portion exposed to said fluid chamber and that is connected to said fluid chamber for movement in response to movement of said flexible member as sensed through said fluid chamber;

and said expanding and contracting member being formed with a rounded portion as a balloon or mushroom shaped configuration.

10. The demand breathing gas regulator as claimed in claim 9 further comprising:

a pilot valve of said regulator that moves in response to pressure differentials on said flexible member; and, a second valve which valves breathing gas through said regulator in response to said pilot valve.

11. The demand breathing gas regulator as claimed in claim 10 further comprising:

said expanding and contracting member has a compound curved portion formed with at least one convex and one concave portion.

12. A contaminant shielding system for a breathing gas demand regulator comprising:

a demand breathing gas regulator adapted for connection to a source of breathing gas and a user's mask;

a flexible member fluidically connected on one side to said source of breathing gas and on the other side to a chamber having a fluid therein; and, an expanding and contracting member substantially sealing the fluid within the chamber and in fluid communication with the fluid in said chamber which expands and contracts in response to movement of said flexible member.

13. The contaminant shielding system for a breathing gas demand regulator as claimed in claim 12 wherein:

said expanding and contracting member is formed of an elastomer.

14. The contaminant shielding system for a breathing gas demand regulator as claimed in claim 13 wherein:

said flexible member is at least in part a diaphragm.

15. The contaminant shielding system for a breathing gas demand regulator as claimed in claim 14 wherein:

said expanding and contracting member has at least either one convex or one concave portion exposed to the fluid in said chamber.

16. The contaminant shielding system for a breathing gas demand regulator as claimed in claim 15 further comprising:

said system is connected with a self contained breathing apparatus (SCBA).

17. A method for providing regulated breathing gas through a demand regulator comprising:

providing a source of breathing gas;

regulating said breathing gas to an intermediate pressure by a first stage regulator;

conducting said intermediate pressure gas to a demand regulator;

regulating said intermediate pressure by the demand regulator having a flexible member exposed on one side to a chamber having a fluid therein and on the other side to breathing gas;

providing an expanding and contracting sealing member exposed to the fluid in said chamber; and, allowing said expanding and contracting sealing member to expand and contract in response to movement of said flexible member.

18. The method as claimed in claim 17 further comprising:

said flexible member is formed at least in part from an elastomer.

19. The method as claimed in claim 17 further comprising:

said intermediate pressure is regulated by a valve mechanism connected to said flexible member.

20. The method as claimed in claim 19 further comprising:

providing an expanding and contracting member having a convex or concave side exposed to the fluid in said chamber.

21. A regulator assembly for use in a breathing apparatus, the regulator assembly comprising a valve assembly comprising an inlet for connection to a source of breathing gas, an outlet for connection to a facepiece to provide breathing gas to a user and an actuator for controlling flow of breathing gas between the inlet and the outlet, a flexible elastomeric diaphragm in operative connection with the actuator, the diaphragm being exposed to ambient pressure on a first side thereof and a positive pressure within the facepiece on a second side thereof and an impermeable and flexible member that substantially seals the first side of the diaphragm from toxic substances in the ambient atmosphere while allowing the first side of the diaphragm to experience ambient pressure such that the flexible member moves with the diaphragm during respiration of the user.

22. The regulator assembly of claim 21, wherein the flexible member permits sufficient movement of the diaphragm to maintain operability of the regulator assembly.

23. A regulator for a breathing apparatus comprising a diaphragm comprising an inside surface and an outside surface, the inside surface exposed to breathing gas, the outside surface exposed to a chamber, an opening placing an interior of the chamber in communication with ambient pressure, the diaphragm being isolated from the opening by a flexible member such that ambient pressure is transmitted through the flexible member to the diaphragm while contaminants in ambient air are not readily transmitted through the flexible member to the diaphragm.

24. The regulator of claim 23, wherein the flexible member comprises a bellows configuration.

25. The regulator of claim 24, wherein the bellows configuration is adapted for expansion, contraction, movement or stretching to accommodate fluid movement.

26. The regulator of claim 24, wherein the bellows comprises a stretchable device.

27. The regulator of claim 23, wherein the flexible member comprises a mushroom configuration.

28. The regulator of claim 23, wherein the flexible member comprises a balloon type expansion and contraction member.

29. The regulator of claim 23, wherein the flexible member comprises a secondary diaphragm.

30. The regulator of claim 23, wherein the flexible member is adapted to move in tandem with the diaphragm.

31. The regulator of claim 23, wherein the flexible member comprises a flange that seats on a portion of the regulator.

32. The regulator of claim 31, wherein the portion of the regulator comprises an undercut that receives the flange.

33. The regulator of claim 23, wherein at least a portion of the flexible member is positioned in the chamber.

34. The regulator of claim 33, wherein a majority of the flexible member is positioned in the chamber.

35. The regulator of claim 34, wherein the entire flexible member is position within the regulator.

* * * * *

UNITED STATES PATENT AND TRADEMARK OFFICE

CERTIFICATE OF CORRECTION

PATENT NO. : 7,331,345 B2
APPLICATION NO. : 10/354771
DATED : February 19, 2008
INVENTOR(S) : David V. Haston It is certified that error appears in the above-identified patent and that said Letters Patent is hereby corrected as shown below:

At column 2, line 67, after "or" insert --expansion and contraction member moving in concert with--.

At column 3, line 15, please delete "to" and insert therefore, --through--.

At column 12, line 2, please delete "thereof" and insert therefore, --thereof,--.

Signed and Sealed this

Thirteenth Day of October, 2009

David J. Kappos

David J. Kappos
*Director of the United States Patent and Trademark Office*